United States Patent [19]

Dean et al.

[11] Patent Number: 4,462,513

[45] Date of Patent: Jul. 31, 1984

[54] TESTING COINS

[75] Inventors: Robert Dean, Slough; Paul S. Raphael, Wokingham, both of England

[73] Assignee: Mars, Inc., McLean, Va.

[21] Appl. No.: 308,548

[22] PCT Filed: Feb. 5, 1981

[86] PCT No.: PCT/GB81/00014

§ 371 Date: Oct. 2, 1981

§ 102(e) Date: Oct. 2, 1981

[87] PCT Pub. No.: WO81/02354

PCT Pub. Date: Aug. 20, 1981

[30] Foreign Application Priority Data

Feb. 6, 1980 [GB] United Kingdom ..... 8004028

[51] Int. Cl.[3] ..... G07F 3/00

[52] U.S. Cl. ..... 194/100 A; 73/163

[58] Field of Search ..... 194/100 A, 100 R, 97 R; 73/163

[56] References Cited

U.S. PATENT DOCUMENTS

| | | | |
|---|---|---|---|
| 3,682,286 | 8/1972 | Prumm | 194/100 A |
| 3,738,468 | 6/1973 | Prumm | 194/100 A |
| 3,870,137 | 3/1975 | Fougere | 194/100 A |
| 3,918,564 | 11/1975 | Heiman et al. | 194/100 A |
| 3,933,232 | 1/1976 | Searle et al. | 194/100 A |
| 4,385,684 | 5/1983 | Sugimoto et al. | 194/100 A |

FOREIGN PATENT DOCUMENTS

| | | |
|---|---|---|
| 2723516 | 12/1978 | Fed. Rep. of Germany . |
| 1327820 | 8/1973 | United Kingdom . |

*Primary Examiner*—Joseph J. Rolla

*Attorney, Agent, or Firm*—Davis Hoxie Faithfull & Hapgood

[57] ABSTRACT

A coin testing apparatus comprises transmitting and receiving coils on opposite sides of a coin passageway. The transmitting coil is connected to high and low frequency oscillators. In the high frequency channel the signal is amplitude controlled by a voltage controlled amplifier rectified by a rectifier and smoothed by a long time-constant circuit. The initial rise in level caused by a coin entering between the coils is detected by an instantaneous level change comparator which responds to the rate of change of signal level at the output of the long time-constant circuit becoming equal to a preset threshold and causes a normally closed switch to be opened. When the switch is closed a comparator compares the signal with a reference value from a source and adjusts the gain of the amplifier until the signal corresponds to the reference value. Upon the arrival of the coin the switch is opened and a long time-constant circuit causes the gain of the amplifier to be maintained at the level before the arrival of the coin. A window comparator compares the difference in voltage with voltage ranges for acceptable coins. A similar arrangement is provided in the low frequency channel but with two differences. The switch in the low frequency channel is operated by the same instantaneous level comparator as is used for the high frequency channel and instead of a rectifier a novel sample and hold technique is used for providing a d.c. signal from the output of the amplifier.

25 Claims, 5 Drawing Figures

TESTING COINS

The present invention relates to improvements in and relating to apparatus for testing coins.

Electronic techniques are widely known for checking the validity of coins. One common technique is to subject a coin in a test position to an inductive test, involving the use of a sensing coil or a transmit/receiver coil arrangement, and to compare the output signal produced with narrow ranges of reference values corresponding to acceptable coins of different recognized denominations.

It is possible to make such apparatus more selective so that in addition to rejecting non-metallic objects and objects of ferrous metal it will also reject some denominations of unacceptable coins. This is achieved by reducing the range of amplitudes of the high and/or low frequency components for which the mechanism will give an acceptance signal. There are however difficulties in producing a reliable coin mechanism of this kind with high selectivity. Because of the nature of the mechanism it is necessary to adjust each mechanism individually before it is released from the factory in order to compensate for variations in components within the range of manufacturing tolerances, for example, variations in the air gap between transmitter and receiving coil. There are also the long term effects of temperature drift and long term ageing of the components of the system.

In our United Kingdom patent specification No. 1443934 we described a coin mechanism in which the difference between the values of the output signal when a coin is in the test position and when no coin is present is compared wlth corresponding values for acceptable coins. These measures result in a significant improvement over the difficulties referred to, and yet can be realised in practice in a comparatively simple way.

The present invention is concerned with tackling the sample problem but in another way which can be made in some embodiments to substantially eliminate such difficulties.

According to the invention from a first aspect there is provided apparatus for testing coins, comprising a coin passageway, means for producing an electrical signal of which a parameter varies on the passage of a coin into a test position along the coin passageway in dependence on a characteristic of the coin, and means for examining the variation of said parameter as a test for coin acceptability, characterised by automatic control means operative to vary the interdependence of said parameter and the said characteristic so as to hold the value of said parameter invariant in the absence of the coin, and by means operative to stop the interdependence of said parameter and said characteristic being varied during the determination of coin acceptability.

With this arrangement the interdependence of said parameter and said characteristic is controlled so that the value of said parameter is held invariant until immediately prior to the arrival of the coin being tested. Thus, provided the circuit components have linear characteristics and are kept out of saturation the effects of long term temperature drift and ageing and mechanical changes in the coin testing apparatus will have no effect on the value of the said parameter when the coin is in the test position. Because the parameter-to-characteristic interdependence is automatically set up by the automatic control means, there is no need for initial adjustment of the apparatus.

With reference to a second aspect of the invention, in the transmit/receive coil arrangement briefly referred to above, a transmitter coil is arranged on one side of a coin passageway to transmit an oscillating magnetic field across the passageway to a receiving coil. When a coin passes between the two coils, the attenuation of the magnetic field between the coils is a function of the thickness of the article and the material from which it is made. By examining the attenuation of the signal induced in the receiver coil, it is possible to distinguish between coins of different material and/or thickness.

One convenient technique for processing the signal induced in the receiver coil is to half-wave rectify it and then pass the rectified signal through a smoothing circuit to produce a substantially DC signal whose amplitude is examined to see whether the minimum signal amplitude, when the coin is in the test position between the two coils, corresponds within a predetermined tolerance to a reference level representative of an acceptable coin. The choice of time constant of the smoothing circuit is a compromise between firstly minimising the ripple voltage in the rectified signal and secondly allowing the signal amplitude, during the passage of the coin between the transmit and receive coils, to be followed accurately. The selected frequency for the oscillating magnetic field depends upon the coin materials which are to be distinguished. At a frequency of, say, approximately 25 kHz which is suitable for distinguishing between some coin materials, a compromise time constant value can be selected which will provide satisfactory results. However, at lower frequencies, for example 2 to 3 kHz, it becomes more difficult to find a suitable value of the time constant which will minimise the ripple component sufficiently and yet enable the signal attenuation to be tracked accurately enough. This is particularly the case as the period of the attenuation caused by the passing coin comes closer to the period of the oscillation so that a smoothing circuit with a time constant that is sufficiently long to suppress the ripple voltage might also have a significant effect on the amplitude of the second signal. In addition, the error in following the attenuation of the signal is affected more significantly at such lower frequencies by variations in the RC circuit values due to manufacturing tolerances, and also by the phase of the transmitted frequency at the instant when the coin is momentarily in the test position between the two coils.

Acccording to the invention from a second aspect there is provided apparatus for testing coins, comprising a coin passageway, means for producing an oscillating electrical signal which is attenuated on the passage of a coin into a test position along the coin passageway to a degree dependent upon a characteristic of the coin, and testing means for examining the degree of attenuation of said signal as a test for coin acceptability, characterised in that said testing means comprises a sampling circuit arranged to sample peaks of the oscillating signal, and a detector for examining whether the amplitudes of the sampled peaks are indicative of a acceptable coin.

Turning now to another aspect of the invention, electronic coin arrival detectors for use in coin mechanisms are known. For example, British patent specification No. 1255492 discloses an arrival sensing coil mounted on a coin inlet chute which guides coins onto the face of a disc which is rotated to transport the coins along a common path. A number of different tests are then carried out on each coin to determine whether the coin is acceptable. The sensing coil forms part of an oscillator circuit including an oscillator which provides a signal indicative of the passage of a coin through the coin chute. This signal serves to render operative all electrical circuits and equipment of the machine. Long term effects such as temperature variation or ageing of components of the system could cause changes in the oscillating signal which might erroneously be determined by the oscillator as representing the passage of a coin through the entry chute. Also, variations in manufacturing tolerance might necessitate carefully setting each individual coin mechanism at the time of manufacture so that it will operate in the desired manner.

The present invention is concerned with a coin arrival detector which substantially overcomes these difficulties.

According to the invention from a third aspect, there is provided a coin arrival detector comprising detector means alongside a coin passageway for producing an electrical signal of which a parameter varies in dependence upon a characteristic of coin travelling along the passageway, and circuit means arranged to detect coin arrival by examining the variation of said parameter, characterised in that the circuit means is arranged to detect coin arrival in response to the value of a function, dependent on the rate of change of said parameter, becoming equal to a predetermined level.

The difficulties referred to are substantially overcome because any variations in the value of said parameter just prior to coin arrival will have little or no effect on the rate of change of the parameter during the passage of the coin past the detector means.

Although the first and third aspects will later be described with reference to a coin testing apparatus of the transmit/receive kind mentioned above, it will be appreciated that the invention is applicable to other kinds of mechanism in which the change in value of a parameter (such as amplitude, frequency or phase) of a signal when a coin passes is examined.

An embodiment of the invention will now be described by way of example with reference to the accompanying drawings of which:

Figure 1:
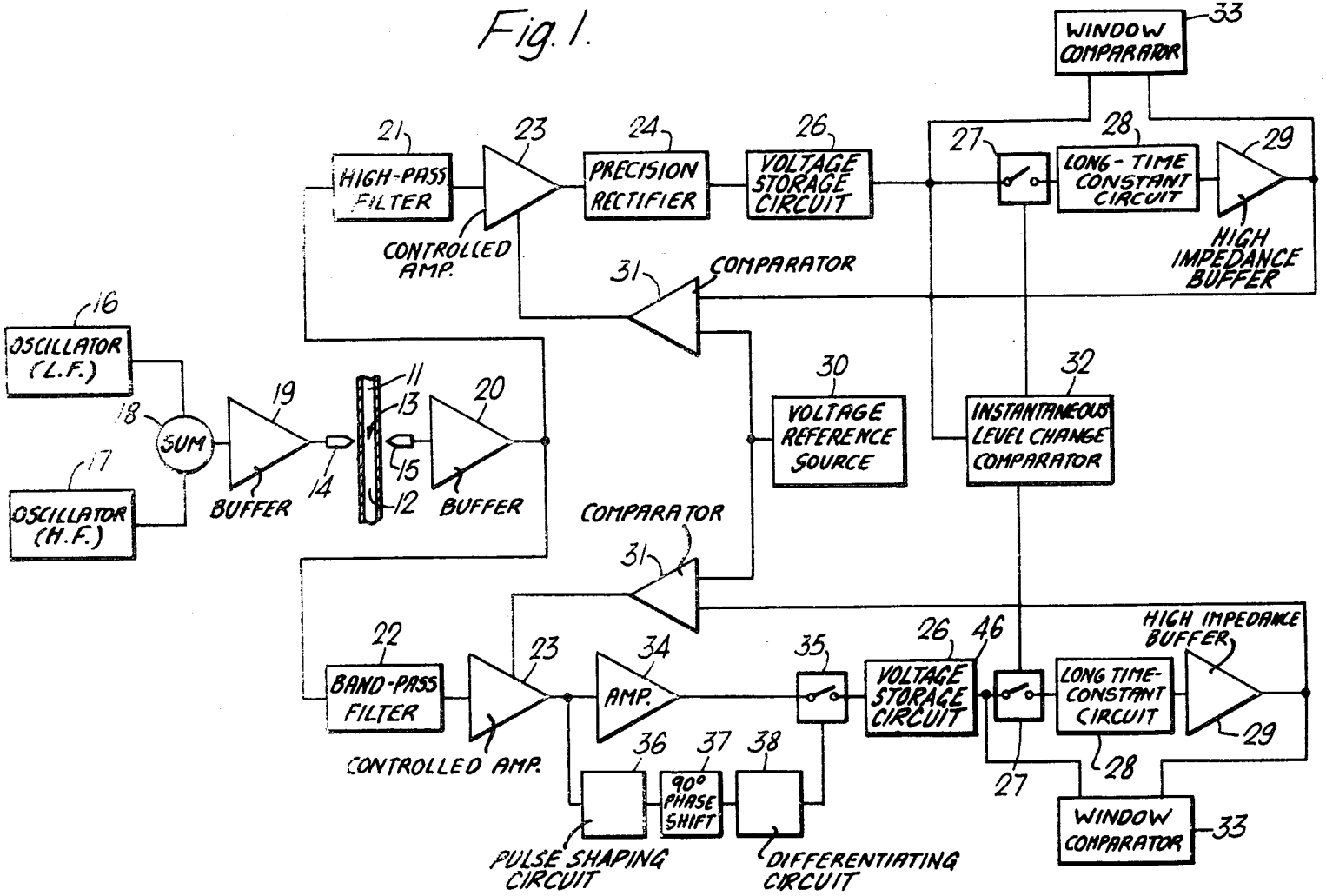
FIG. 1 shows a block diagram of an apparatus according to the invention.

Referring to FIG. 1, this shows a coin passageway 11 with an inclined coin track 12 on which a coin can roll through a test position 13. On opposite sides of the coin passageway at the test position 13 are two coils or inductors 14 and 15. Two oscillators 16 and 17 are connected through a summing circuit 18 and a buffer circuit 19 to the coil 14 which serves as a transmitting coil. The oscillator 16 operates at a relatively low frequency, say 2 kHz, and the oscillator 17 operates at relatively high frequency, say 25 kHz. The coil 14 is fed with a composite electrical signal with 2 kHz and 25 kHz components. The coil serves as a transmitting coil and generates a magnetic field across the coin passageway. The coil 15 on the opposite side of the passageway serves as a receiving coil and is so arranged that a coin passing between the coils 14 and 15 attenuates the received signal, the amount of attenuation being a function of the coins conductivity and its thickness. A particular metal may attenuate one frequency to a greater extent than the other frequency. By comparing the attenuation produced by a coin under test at both frequencies with ranges of values for particular denominations of acceptable coins, a coin test with good selectivity as to coin material and thickness can be performed. In practice it may be sufficient to test for each particular denomination of coin at one frequency only, the frequency chosen for that coin being the one that gives the best attenuation, 50% attenuation being the optimum. Alternatively there may be ranges of values for high and low frequency attenuation for each denomination of coin and a coin will only pass the test if the attenuation at high and low frequencies corresponds to the ranges of values for the same denomination of coin.

The output from the receiving coil 15 is fed to a buffer and amplifying circuit 20 and then split into the two frequencies of the oscillators 16 and 17 by a high pass filter 21 and a low frequency band pass filter 22. The separated high frequency signal is amplitude controlled by a voltage controlled variable gain attenuator/amplifier 23. The control of the amplifier will be described below. The output of the amplifier 23 is half-wave rectified by a precision half-wave rectifier 24 and inverted. At this stage a fixed gain is also introduced. The output of the rectifier 24 is held out of saturation by applying a suitable reference voltage to the positive input of the operational amplifier 25 (see FIG. 2B) of the precision rectifier 24. The half-wave rectified wave form is smoothed by a voltage storage or smoothing circuit 26 of relatively long time-constant to provide a DC voltage proportional to the amplitude of the signal from the high pass filter 21. The comparatively long time-constant is chosen so as to keep ripple voltage to a minimum while allowing the output to follow the attenuation of the signal during the passage of a coin between the coils.

The output of the smoothing circuit 26 is fed through a normally-closed analogue switch 27 to a long time-constant circuit 28 (longer time-constant than that of the smoothing circuit 26) and a high impedance buffer 29. The output of the high impedance buffer is compared with a zenered reference voltage from the voltage reference source 30 by means of a comparator or integrator 31. The difference error signal is integrated and used to control the gain of the voltage controlled amplifier/attenuator 23. When the switch 27 is closed the gain of the amplifier 23 will be varied until the error signal at the integrator 31 is zero, at which time the voltage from the buffer circuit 29 will correspond to the fixed reference voltage from the reference source 30. Long term changes in any of the components are compensated for by the loop changing its gain until there is again zero error. In order to hold the voltage at the input to the comparator 31 constant, maximum gain in the feedback loop is required but in order to prevent instability a capacitor 40 (FIG. 2B) is connected across the error signal amplifier 31 to reduce the gain at relatively high frequencies.

An instantaneous level-change comparator 32 is connected to the output of the smoothing circuit 26 to detect the initial rise in level caused when a coin enters between the transmitting and receiving coils. Coins of all materials will cause some attenuation of the high frequency component. Detection of the initial rise in level by the instantaneous level comparator 32 causes it to issue an output signal which opens the normally-closed analogue switch 27. When the switch 27 is open the loop conditions present before the coin arrived are maintained on the other side of the analogue switch by the long time-constant circuit 28 and the high impedance buffer 29 so that the gain of the amplifier 23 is held constant while the coin is validated.

The voltage at the output of the short time-constant circuit 26 and the output voltage of the high impedance buffer 29 are fed separately to a window comparator 33. The window comparator determines whether the minimum voltage at the output of the short time-constant circuit 26, which occurs when a coin passes into the test position between the coils 14, 15, falls within a predetermined tolerance of a preselected fraction of the output voltage of the buffer 29 corresponding to an acceptable coin.

Figure 2A:
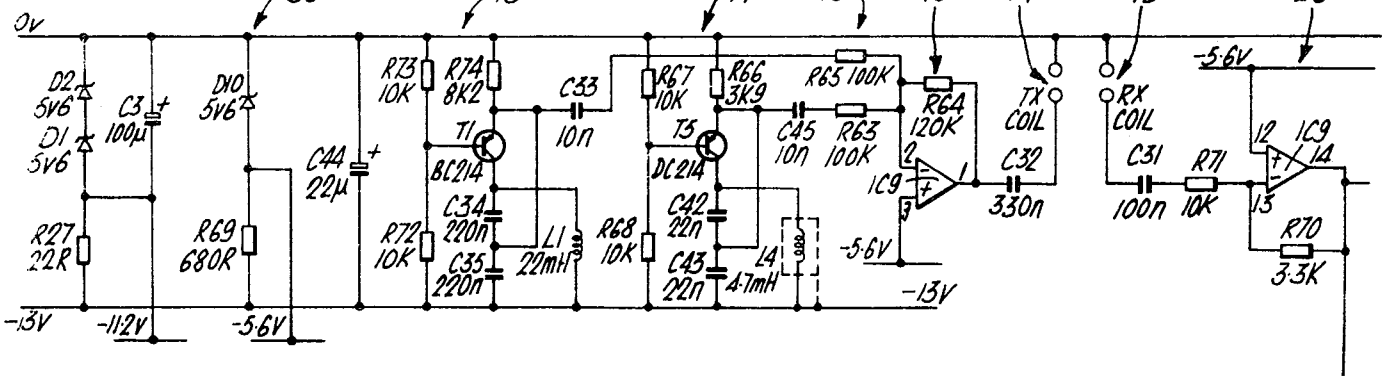
FIGS. 2A and 2B show the circuit diagram of one preferred circuit for realising the apparatus of FIG. 1.
Figure 2B:
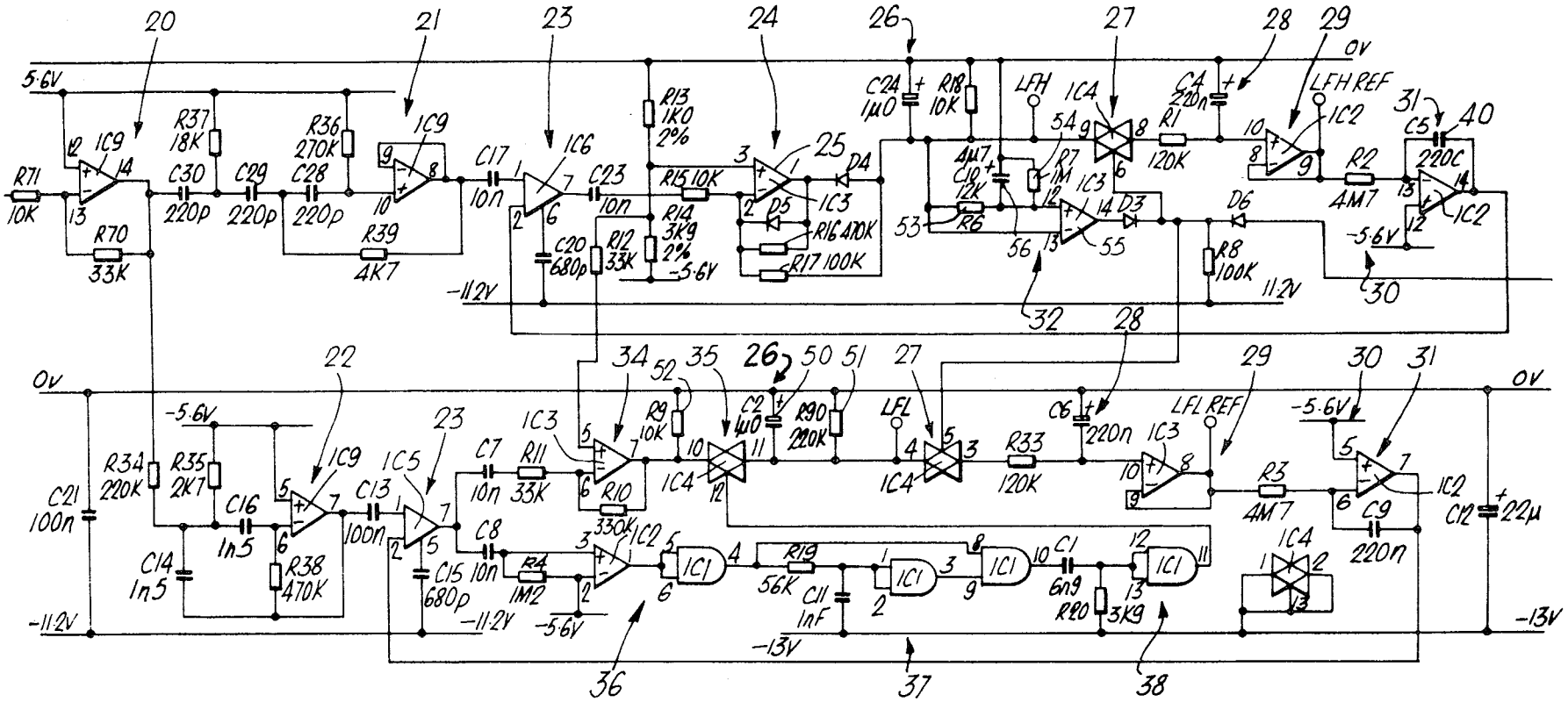

The low frequency channel is similar in many respects to the high frequency channel and corresponding components have been given the same reference numerals in FIG. 1 and FIGS. 2A and 2B. There are however two major differences.

Firstly the loop switch 27 in the low frequency channel is operated by the same instantaneous level comparator 32 as the high frequency channel. This is preferred because all coins will cause some attenuation in high frequency component but not necessarily in the low frequency component. This arrangement also avoids unnecessary duplication of circuitry.

Secondly, rather than converting the AC signal to a DC signal by a precision rectifier followed by a smoothing circuit, a sample and hold technique is used. This is because, at frequencies of the order of 2 kHz, it may not be possible to choose a time-constant for the smoothing circuit which will enable the ripple voltage to be eliminated sufficiently and yet whose output can track the signal attenuation due to the coin passing between the coils accurately enough. In putting the sample and hold technique into effect, the output of the voltage controlled amplifier/attenuator 23 in the low frequency channel is split into a forward signal path and a control channel. The signal in the forward path is fed to an inverting amplifier 34 which is biased to near the positive rail so that only the negative half-cycles remain out of saturation after amplification. The amplified signal is fed to a two-way analogue switch 35. The control signal is squared by a pulse-shaping circuit 36, shifted in phase by 90° by a phase shifter 37, and differentiated by a differentiating circuit 38 to produce sampling pulses on the negative peaks of the forwarded signal. The sampling pulses cause the analogue switch to be closed on the peaks of the forward signal and the output of the switch is then stored on the capacitor of a voltage storage circuit 46. The circuit and the switch 35 are so arranged that the voltage storage circuit 46 has a low time-constant when the switch 35 is closed, so that it can store the new peak forward signal value rapidly during each sampling, but a high time-constant when the swtich 35 is open, in order that each sampled peak value can be held until the next sampling. The long term loop control of the low fequency channel is the same as for the high frequency channel. The voltage signal at the output of the voltage storage circuit 46, and also the output signal of the high impedance buffer 29, are fed to a window comparator 33 which functions in corresponding manner to the window comparator in the high frequency channel.

In the case of the circuit illustrated in FIG. 2B, it will be seen that the voltage storage circuit 46 comprises, a parallel arrangement of a capacitor 50 and a resistor 51, connected between the output side of the switch 35 and the 0 volt rail and a resistor 52 connected between the output of the inverting amplifier 34 and the 0 volt rail at the input side of the switch 35. Thus, when the switch is open the circuit 46 has a long time-constant determined by the RC circuit 50,51, but the circuit 46 has a short time-constant determined by the values of the elements 50,51,52 when the switch 35 is closed.

Figure 3:
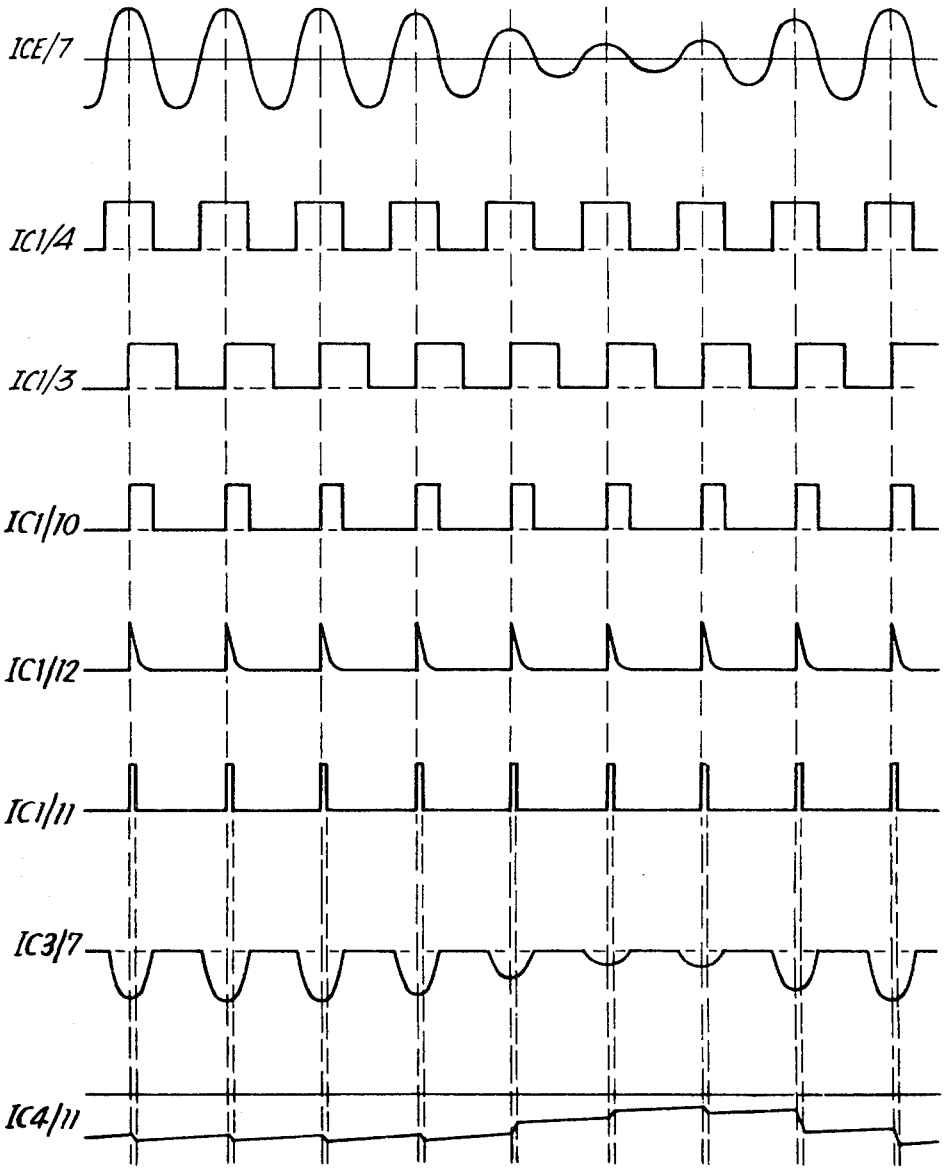
FIGS. 3 and 4 show various waveforms for illustrating operation of parts of the circuitry shown in FIGS. 2A and 2B.

FIG. 3 shows the signal waveforms at different points in the circuitry constituting the components 26 and 34 to 38 in FIG. 1, each waveform being referred to the corresponding pin reference in FIG. 2. The nature of the several waveforms will be self-evident from the foregoing description, but it is added that for the duration of each sampling pulse (ICI/11) pin IC4/11 will rapidly charge or discharge to the newly sampled potential on pin IC3/7 due to the short time-constant of the voltage storage circuit 46. During the interval between the sampling periods the potential of pin IC4/11 decays only very slowly, as shown, due to the long time-constant of the RC-network comprising the elements 50 and 51.

Advantages of the sample-and-hold technique are that there is no practical lower limit on the channel frequency that can be used, that very low ripple voltages can be achieved and that sampling the amplified a.c. waveform from a low output impedance source allows coin attenuations approaching 100% to be measured without rate of change of voltage restrictions on the short time-constant components. Although the sample-and-hold technique has been described in the particular context of coin testing apparatus incorporating long term loop control of the low and high frequency channels, it will be readily understood that the technique can be used in other kinds of testing apparatus in which an oscillating signal is produced which is attenuated during the passage of a coin through the test position by an amount dependent upon characteristics of that coin particularly at lower frequencies such as 2 kHz.

A preferred form of instantaneous level change comparator 32 will now be described with particular reference to the circuit diagram of FIG. 2B and the waveform diagram of FIG. 4. Waveform IC3/1 indicates the output voltage from the half-wave rectifier 24 during the passage of a coin through the test position. The dotted line indicates the attenuation of the signal amplitude due to the coin. The rectifier output voltage is applied to the smoothing circuit 26 whose time constant is chosen such that the output voltage of the smoothing circuit is able to follow the attenuation of the signal during the passage of a coin between the two coils. The smoothing circuit output d.c. voltage is fed separately, on the one hand directly to one input of a comparator 55 and the other hand through a voltage dividing network comprising resistors 53 and 54 to the other inputs of an comparator 55. The signal fed to input pin IC3/12 of comparator 55 is also fed to a storage capacitor 56 which introduces a phase lag into the d.c. signal applied to pin IC3/12. The time lag is indicated by time $T_o$ in FIG. 4. In addition, the peak amplitude of the signal IC3/12 is less than that on pin IC3/12 because of the voltage dividing network 53,54.

Figure 4:
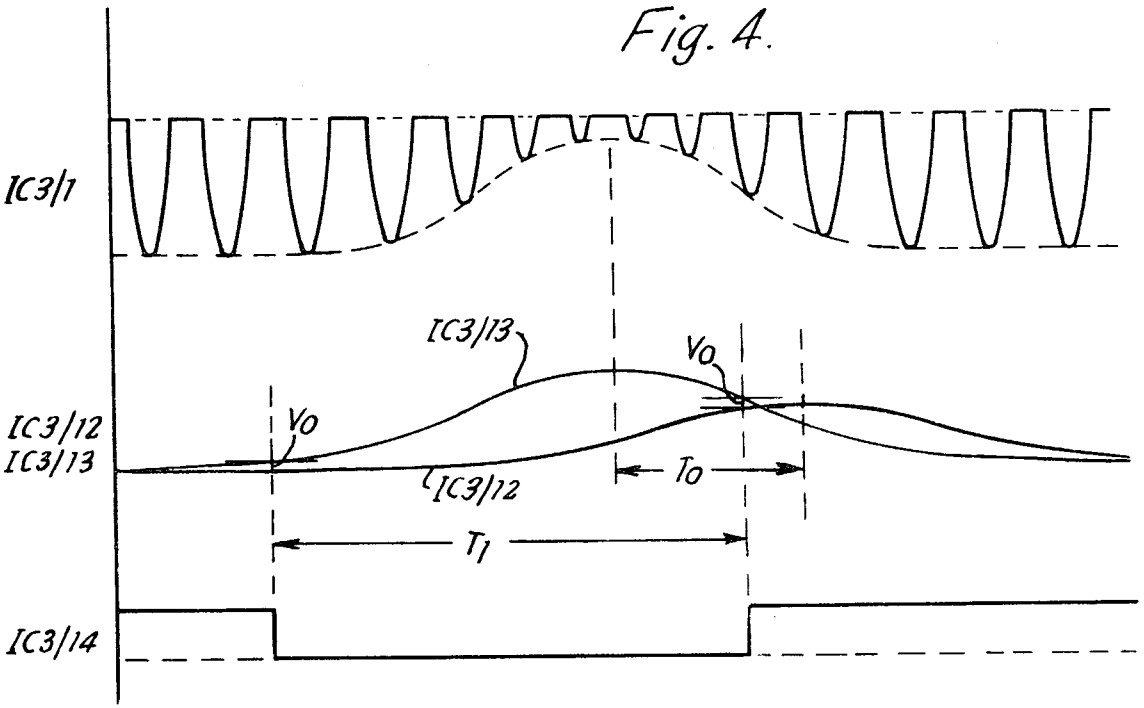

The input signal waveforms applied to comparator 55 are shown in the second diagram of FIG. 4. The comparator 55 is arranged to switch from a high output to a low output when the voltage on pin IC3/13 exceeds the voltage on pin IC3/12 by more than a predetermined voltage $V_o$. Thus, the output voltage on output pin IC3/14 of comparator 55 is changed to a lower value throughout the duration $T_1$, as shown in the third diagram. It is important to note that by chosing the peak amplitude of the voltage on pin IC3/12 as an appropriate fixed fraction of that on pin IC3/13, the duration $T_1$ can be made to last until the coin has passed beyond the test position. This enables the output signal of the instantaneous level change comparator 32 to be used to control the switch 27 directly.

The described instantaneous level change comparator for detecting coin arrival is particularly advantageous in that it responds to changes in slope of the smoothing circuit output voltage, rather than detecting the absolute value exceeding a predetermined threshold. This avoids the need to take special measures to compensate for different component values due to variations in manufacturing tolerance or long term effects such temperature drift and long term ageing of components.

It is to be appreciated that the instantaneous level change comparator could be used, (in conjunction with a suitable detector, producing a variation in its output voltage during the passage of a coin through the test position) in other forms of coin validity checking apparatus merely for detecting coin arrival.

In FIGS. 2A and 2B the integrated circuits are of the following type:

| No. | 1C1 | 1C2 | 1C3 | 1C4 | 1C5 | 1C6 | 1C9 |
|---|---|---|---|---|---|---|---|
| TYPE | 40C1BCP | μAF774PC | TL034CN | 4016DCP | MC3340 | MC3340 | μAF774PC |
| Ov | P1N14 | P1N4 | P1N4 | P1N14 | P1N0 | P1N8 | P1N4 |
| −5v | — | — | — | — | — | — | — |
| −112v | — | P1N11 | P1N11 | — | P1N3 | P1N3 | P1N11 |
| −13v | P1N7 | — | — | P1N7 | — | — | — |

We claim:

1. Apparatus for testing coins, comprising a coin passageway, means (14 to 21, 24, 26) for producing an electrical signal of which a parameter varies on the passage of a coin into a test position along the coin passageway in dependence on a characteristic of the coin, means (33) for examining the variation of said parameter as a test for coin acceptability, and automatic control means (23, 30, 31) operative to regulate the operation of said signal producing means so as to hold the value of said parameter at a controlled value in the absence of the coin, and characterised by means (28,29) operative, while said parameter is varied from the controlled value due to presence of a coin, to store said controlled value of said parameter, and further by said parameter examining means being arranged to derive from said stored value of the parameter a reference value for comparison with the varied parameter value caused by presence of the coin to test for coin acceptability.

2. Apparatus according to claim 1, characterised in that said parameter of said electrical signal is the amplitude of that signal.

3. Apparatus according to claim 2, characterised in that the parameter examining means comprises a comparator (33) arranged to compare the value of said parameter when the coin is in the test position with a predetermined fraction of the value of said parameter.

4. Apparatus according to claim 3 characterised in that the comparator (33) has a first input connected to the output of the electrical signal producing means and a second input which is connected by way of a long time constant circuit (28) and a normally-closed switch (27), when closed, also to the output of the electrical signal producing means, the switch (27) being arranged to be opened during the determination of coin acceptability and the long time constant circuit (28) serving to maintain the value of the signal to the second input of the comparator (33).

5. Apparatus according to claim 4 characterised in that a normally closed switch (27) is opened by circuit means (32) responsive to the rate of change of said parameter becoming equal to a predetermined level so as to open the switch (27).

6. Apparatus according to claim 2, characterised in that the automatic control means comprises a variable gain amplifier (23) in the electrical signal producing means, the gain of the amplifier (23) being arranged to be varied so as to hold the value of the said parameter at said controlled value in the absence of a coin.

7. Apparatus according to claim 6, characterised by a comparator (31) arranged to compare a signal, whose level is derived from the value of said parameter, with a preset reference value and to generate accordingly a difference signal for controlling the gain of the variable gain amplifier (23) so as to tend to hold the level of the derived signal equal to the preset reference value.

8. Apparatus according to claim 7, characterised by a capacitive device (40) connected across the comparator (31) to reduce the gain of the comparator at higher frequencies.

9. Apparatus according to claim 8, characterised in that the electrical signal producing means includes a transmitting inductor (14) on one side of the coin passageway (11) arranged to produce an oscillating magnetic field across the coin passageway on being fed with an oscillating electrical signal, and receiving inductor (15) on the other side of the coin passageway, the inductors being so arranged that a substantial proportion of the magnetic energy received by the receiving inductor is transmitted through the coin when in the test position.

10. Apparatus according to claim 9 characterised by two signal producing means, the transmitting (14) and receiving (15) inductors being common to both, one including a high pass filter (21) and the other a low pass filter (22) arranged to isolate the high and low frequency components, respectively, of the signal induced in the receiving inductor (15) by the oscillating magnetic field in response to feeding the transmitting inductor (14) with oscillating electrical signals of two substantially different frequencies which are a higher frequency and a lower frequency, the said one signal producing means further comprising the precision rectifier (24) followed by a smoothing circuit (26) arranged to convert said oscillating signal into a DC signal and the other signal producing means further comprising the sampling circuit (35,36,37,38).

11. Apparatus according to claim 10 characterised by means (32) responsive to the variation of said parameter for the high frequency component indicating arrival of a coin in the vicinity of the test position, so as to open the normally closed switch (27).

12. Apparatus according to any one of claims 2 to 4 or 6 to 11, characterised in that the electrical signal producing means is arranged to produce an oscillating electrical signal which is attenuated when a coin passes through the test position, and comprises a sampling circuit (35,36,37,38) arranged to sample peaks of the oscillating signal, the examining means (33) being arranged to detect whether the amplitudes of the sampled peaks are indicative of an acceptable coin.

13. Apparatus for testing coins, comprising a coin passageway, means for producing an oscillating electrical signal which is attenuated on the passage of a coin into a test position along the coin passageway to a degree dependent upon a characteristic of the coin, and testing means for examining the degree of attenuation of said signal as a test for coin acceptability, characterised in that said testing means comprises sampling and storage means (46, 35) operative to sample peaks of the oscillating signal and store the sample value until the next sampling whereby to provide an output signal representing the values of the successive sampled peaks of the oscillating signal during attenuation, the value of said output signal upon sampling any one of the successive peaks being equal to the peak value for that sampling and a detcetor (33) for detecting whether said output signal is indicative of an acceptable coin.

14. Apparatus according to claim 13 characterised by an inverting amplifier (34) for amplifying the oscillating electrical signal before it is sampled, the amplifier being an inverting amplifier which is so biased that only the negative half-cycles remain out of saturation after amplification.

15. Apparatus according to claim 13, characterised in that the storage means comprises a circuit having a short time constant during each sampling.

16. Apparatus according to claim 15 characterised by an inverting amplifier (34) for amplifying the oscillating electrical signal before it is sampled, the amplifier being an inverting amplifier which is so biased that only the negative half-cycles remain out of saturation after amplification.

17. Apparatus according to claim 13 or 15 characterised in that the sampling means comprises a controlled switching device (35) arranged to receive a control signal derived from the oscillating electrical signal so as to close the switching device, when the oscillating electrical signal is at peak amplitude of one polarity, for sampling the peak amplitude.

18. Apparatus according to claim 17, characterised in that the storing means comprises a high time constant RC smoothing network (50,51) arranged to receive an input from the output side of the switching device (35) and a resistive element (52) connected at the input side of the switching device so as to change the time constant of the RC smoothing network to a low value when the switching device is closed.

19. Apparatus according to claim 18, characterised in that the sampling means comprises a 90° phase shift and differentiating circuit (37,38) for producing the control signal.

20. Apparatus according to claim 17, characterised in that the sampling means comprises a 90° phase shift and differentiating circuit (37,38) for producing the control signal.

21. Apparatus according to claim 20 characterised by a pulse shaping circuit (36) for deriving from the oscillating electrical signal a squared input signal for the 90° phase shift and differentiating circuit (37,38).

22. A coin arrival detector comprising detector means adjacent a coin passageway for producing an electrical signal of which a parameter varies in dependence upon a characteristic of a coin travelling along the passageway, and circuit means coupled to said detector means and arranged to utilize said signal for detecting arrival of a coin, characterized in that the circuit means (32) is arranged to detect coin arrival by sensing occurrence of a change in the rate of variation of said parameter.

23. A coin arrival detector as claimed in claim 22, characterised in that said circuit means provides a signal indicative of coin arrival in response to the change in the rate of variation of said parameter exceeding a predetermined value.

24. A coin arrival detector according to claim 22 characterised in that the circuit means (32) comprises a comparator device (55) having a first input arranged to receive a DC signal whose level is proportional to the instantaneous value of said parameter, and also having a second input, and a phase changing circuit (56) arranged to apply the same DC signal with phase lag to said second input, the comparator device, being arranged to generate a coin arrival signal when the potential difference between said first and second inputs exceeds a predetermined amount ($V_O$).

25. A coin arrival detector according to claim 24, characterised by a circuit (53,54) for adjusting in a fixed ratio the relative amplitudes of the DC signal applied to the first and second inputs of the comparator device (55) such that the comparator device will continue to generate the coin arrival signal until after the coin has passed beyond the position on the coin passageway for which the maximum variation of said parameter occurs.

* * * * *

UNITED STATES PATENT AND TRADEMARK OFFICE

CERTIFICATE OF CORRECTION

PATENT NO. : 4,462,513

DATED : July 31, 1984

INVENTOR(S) : Robert Dean and Paul S. Raphael

It is certified that error appears in the above—identified patent and that said Letters Patent is hereby corrected as shown below:

Col. 8, line 45 (claim 9), before "receiving" insert --a--.

Signed and Sealed this

*Twelfth* Day of *February 1985*

[SEAL]

*Attest:*

DONALD J. QUIGG

*Attesting Officer* *Acting Commissioner of Patents and Trademarks*